US008795016B2

(12) United States Patent
Harrison

(10) Patent No.: US 8,795,016 B2
(45) Date of Patent: Aug. 5, 2014

(54) FLOATING CABANA

(76) Inventor: James Harrison, Fort Lauderdale, FL (US)

( * ) Notice: Subject to any disclaimer, the term of this patent is extended or adjusted under 35 U.S.C. 154(b) by 0 days.

(21) Appl. No.: 12/852,845

(22) Filed: Aug. 9, 2010

(65) Prior Publication Data

US 2011/0039465 A1 Feb. 17, 2011

Related U.S. Application Data

(60) Provisional application No. 61/232,095, filed on Aug. 7, 2009, provisional application No. 61/371,362, filed on Aug. 6, 2010.

(51) Int. Cl.
*B63B 35/74* (2006.01)

(52) U.S. Cl.
USPC ..... 441/130; 441/132

(58) Field of Classification Search
USPC ..... D21/803, 809; 441/129, 130, 132
See application file for complete search history.

(56) References Cited

U.S. PATENT DOCUMENTS

| | | | | | |
|---|---|---|---|---|---|
| 3,067,441 | A * | 12/1962 | Dysard et al. | 441/132 |
| 3,444,568 | A * | 5/1969 | Vogelsang | 114/357 |
| 3,471,875 | A * | 10/1969 | Lyon | 441/130 |
| 5,004,296 | A * | 4/1991 | Ziegenfuss, Jr. | 297/188.14 |
| 5,403,220 | A * | 4/1995 | Goad, Sr. | 441/130 |
| 5,570,649 | A * | 11/1996 | Austin | 114/61.2 |
| 5,746,150 | A * | 5/1998 | Beaulac et al. | 114/248 |
| 6,345,585 | B1 * | 2/2002 | Hovda et al. | 114/362 |
| 2010/0095877 | A1 * | 4/2010 | Scadden | 114/61.25 |

* cited by examiner

*Primary Examiner* — Edwin Swinehart
(74) *Attorney, Agent, or Firm* — Robert M. Schwartz

(57) ABSTRACT

The present invention is floating lounge that provides a central corridor between two lounge portions and a floating base supporting said lounge. The two lounge portions each have a concave channel extending along the length of each lounge portion on the underside of the cabana.

12 Claims, 10 Drawing Sheets

FLOATING CABANA

INDEX TO RELATED APPLICATIONS

This application claims benefit to U.S. Provisional Patent No. 61/232,095 filed Aug. 7, 2009 and U.S. Provisional Patent No. 61/371,362 filed Aug. 6, 2010 the disclosures of which are incorporated herein by reference in their entirety.

BACKGROUND OF THE INVENTION

The recreation industry is replete with articles intended to improve the comfort and convenience of sunbathers, pool patrons, and beachgoers. The simple beach lounge has evolved into the central component of floating lounges. Typically, floating lounges are single and double units. A double unit usually includes a broad area for two persons to lounge side by side. While these floating lounges have provided greater service and convenience to their users they still have shortcomings. One particular shortcoming is that a user is required to enter and leave the floating lounge portion on the outermost edges of the elongated side. Another difficulty is the floating lounges do not generally provide for any removable shade devices.

The present invention addresses these problems. The floating lounge of the present invention provides a central corridor or passage through which the user may enter and lie down or sit on either lounge portion and the lounge has incorporated shade devices.

BRIEF SUMMARY OF THE INVENTION

In one embodiment the present invention provides a novel configuration for a floating lounge. The floating lounge provides for two users to have individual lounge chair type portions. Further the configuration of the present invention has a passageway between the individual lounge chair portions and provides the ability of a person to enter and leave in the area between the two lounge chair portions.

In one embodiment the floating lounge of the present invention may be described as:

A floating lounge comprising:

(a) a single base constructed and arranged to float while supporting up to 700 lbs.;

(b) two lounge portions on said base;

(c) a passage between said lounge portions sufficient to allow a user to pass; wherein said passage is adjacent to each of said portions.

DETAILED DESCRIPTION OF THE PREFERRED EMBODIMENTS

Figure 1:
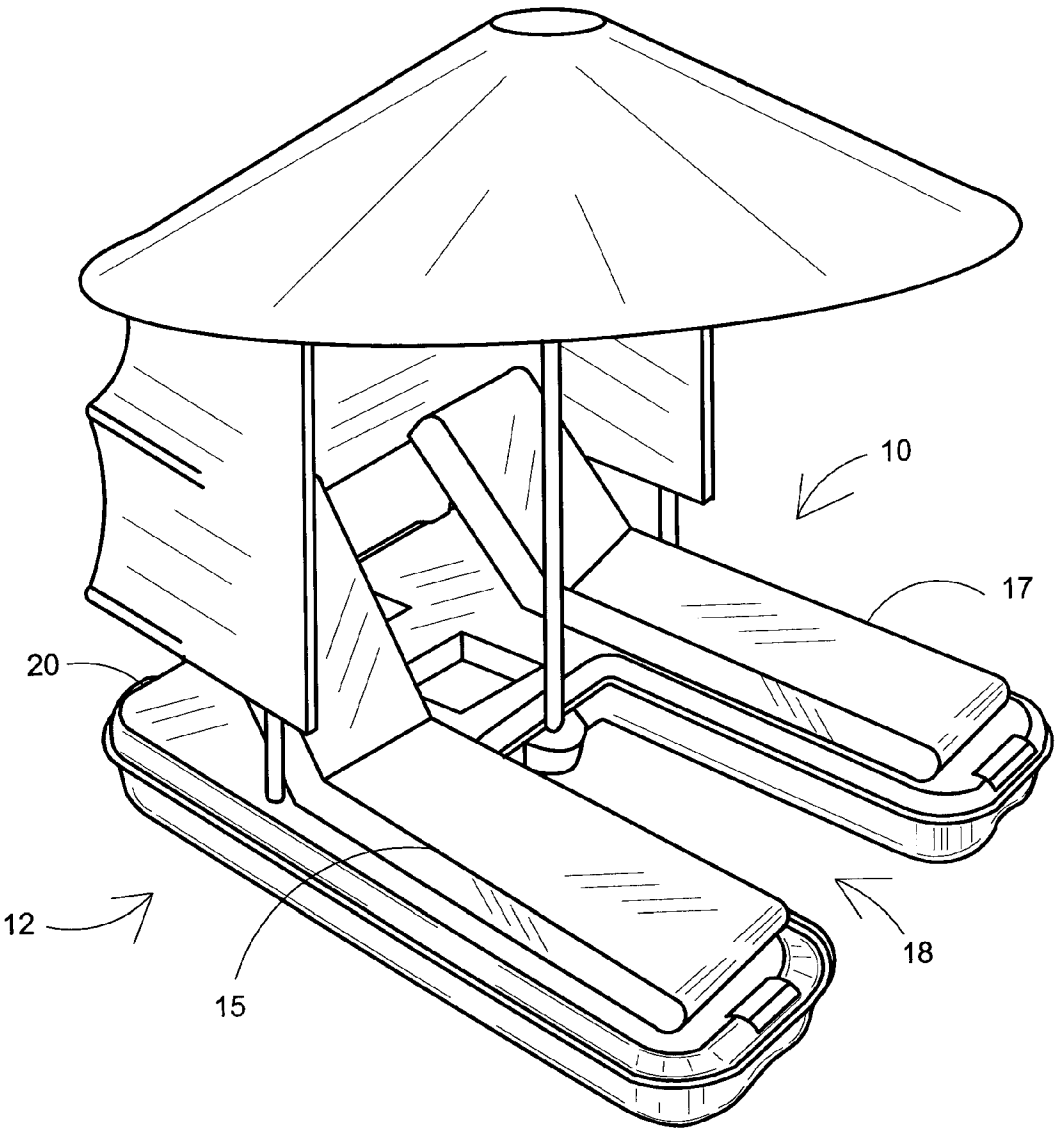
FIG. 1 is a perspective view of the floating cabana.
Figure 2:
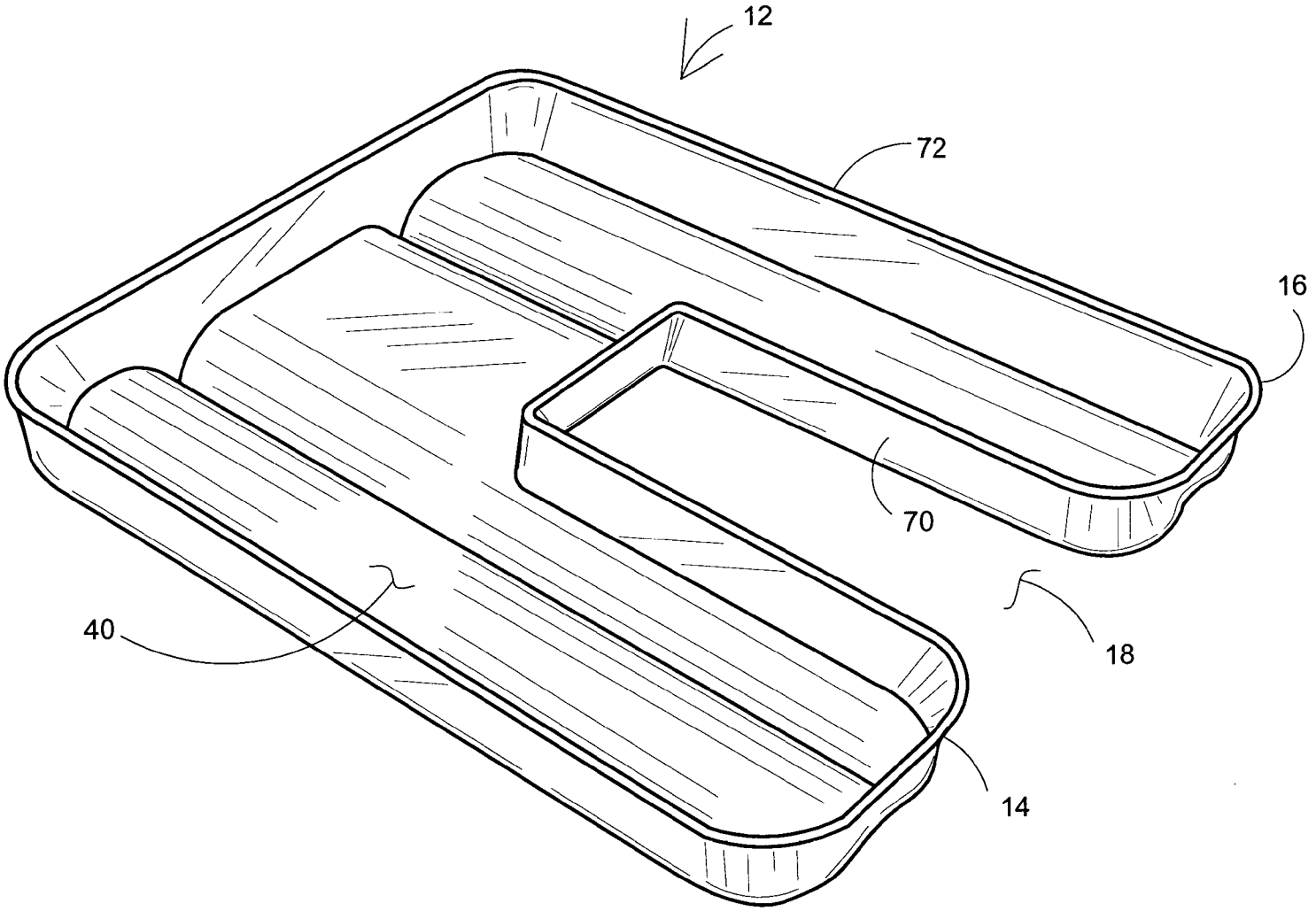
FIG. 2. is a top perspective view of the floating cabana base portion.
Figure 3:
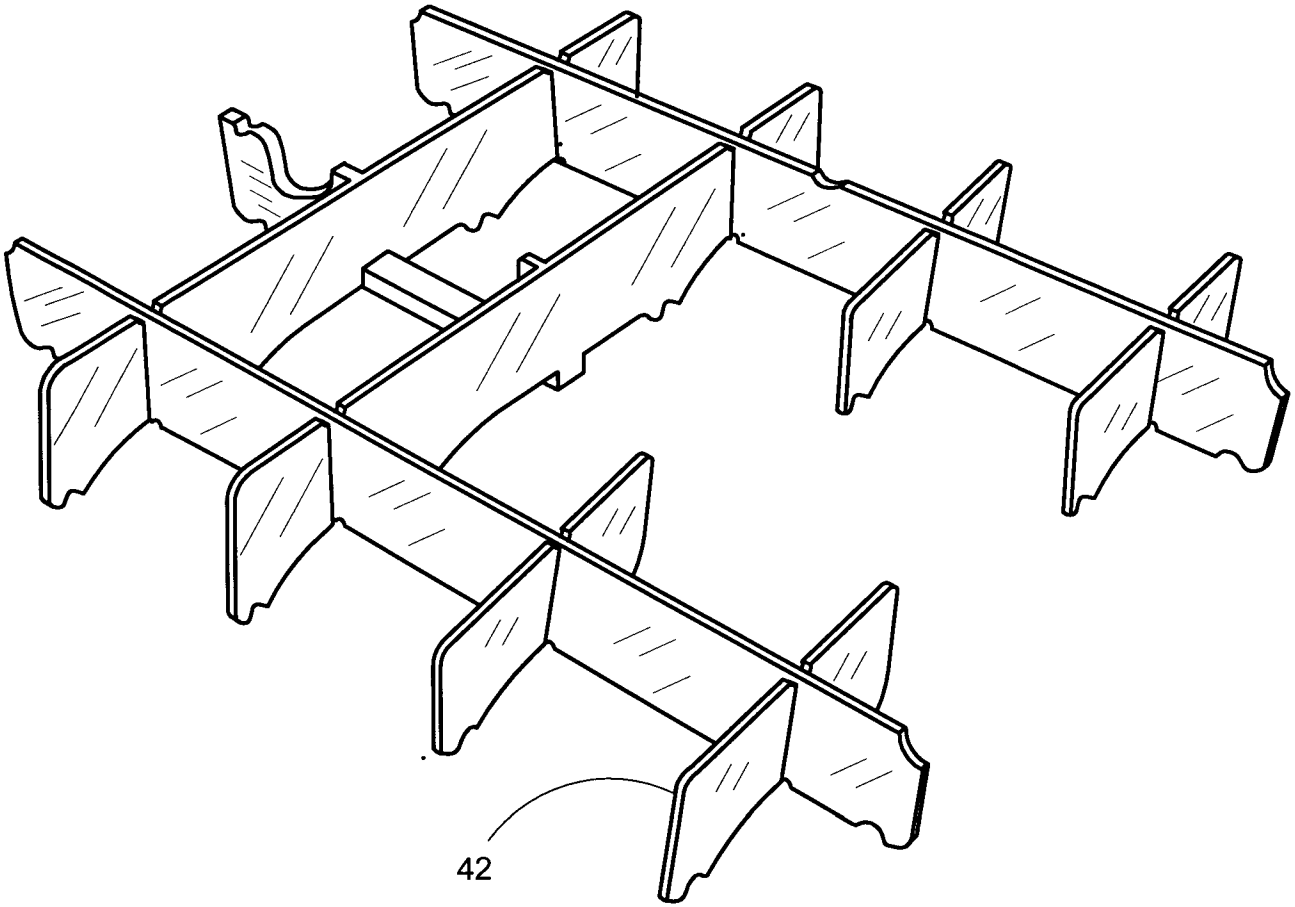
FIG. 3 is a top perspective view of the floating cabana base portion inner support structure.
Figure 4:
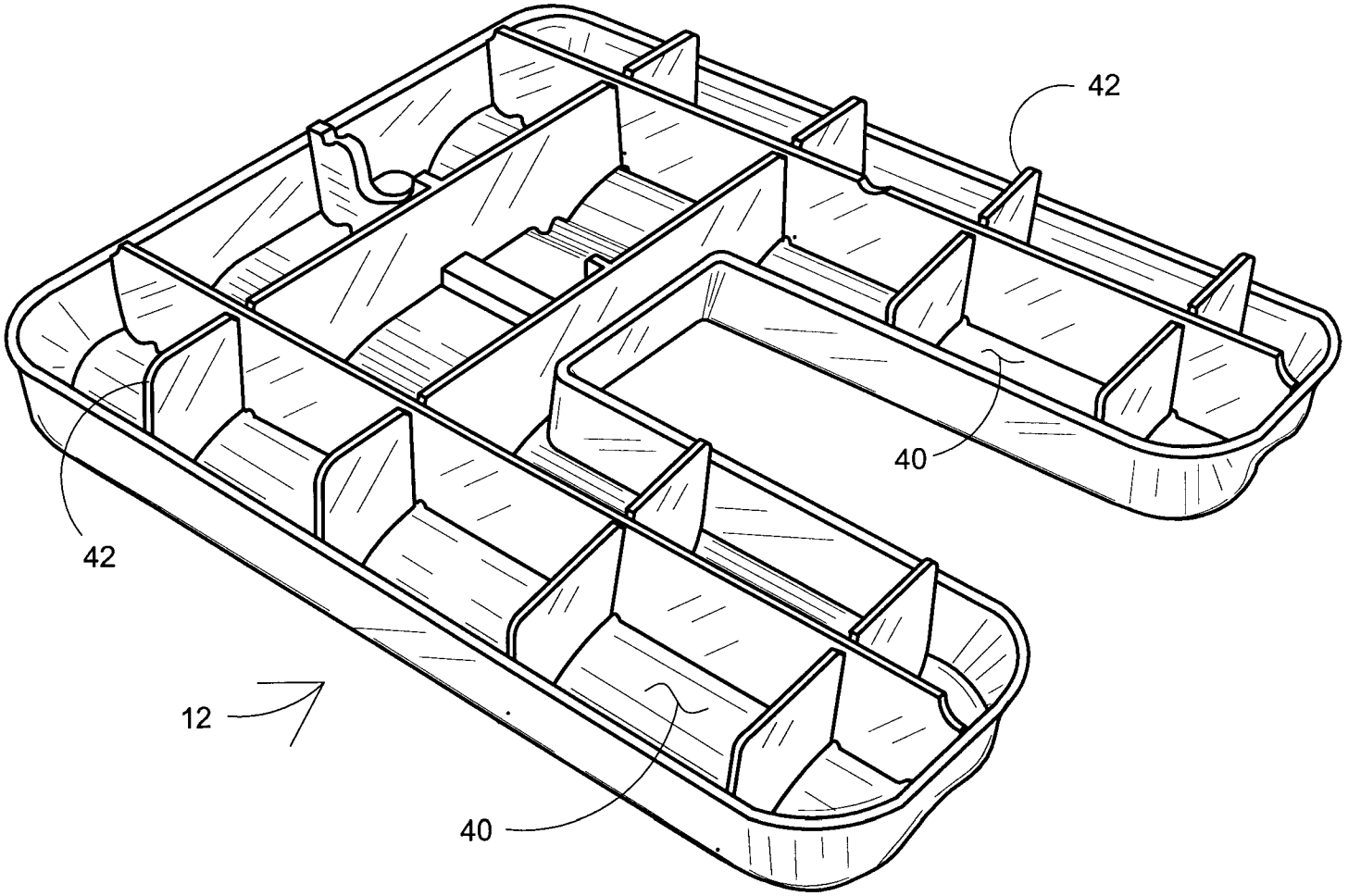
FIG. 4 is a top perspective view of the floating cabana base portion depicting placement of inner support structure therein.
Figure 5:
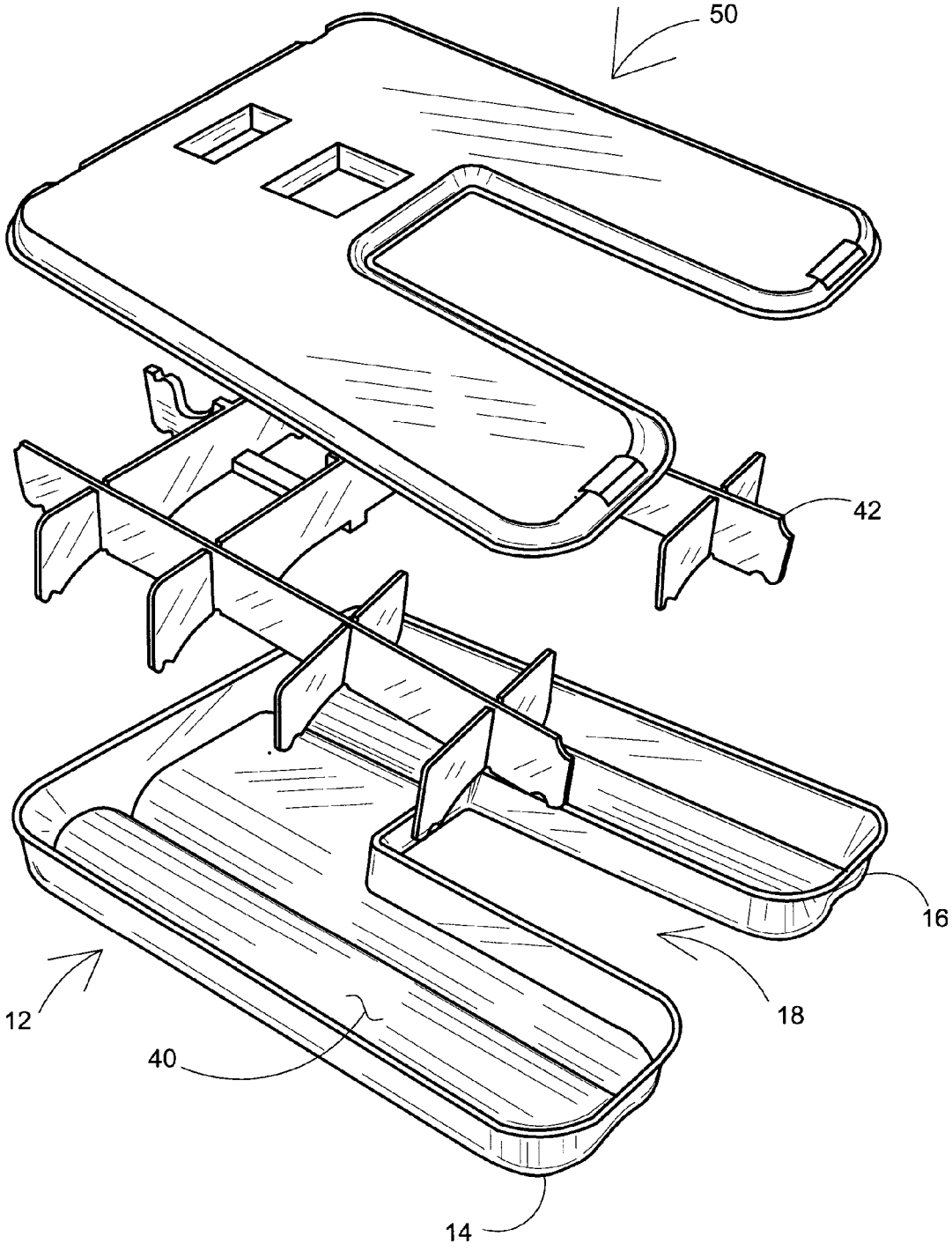
FIG. 5 is a top perspective view of the floating cabana base portion depicting placement of inner support structure therein and covered with the base cover.
Figure 6:
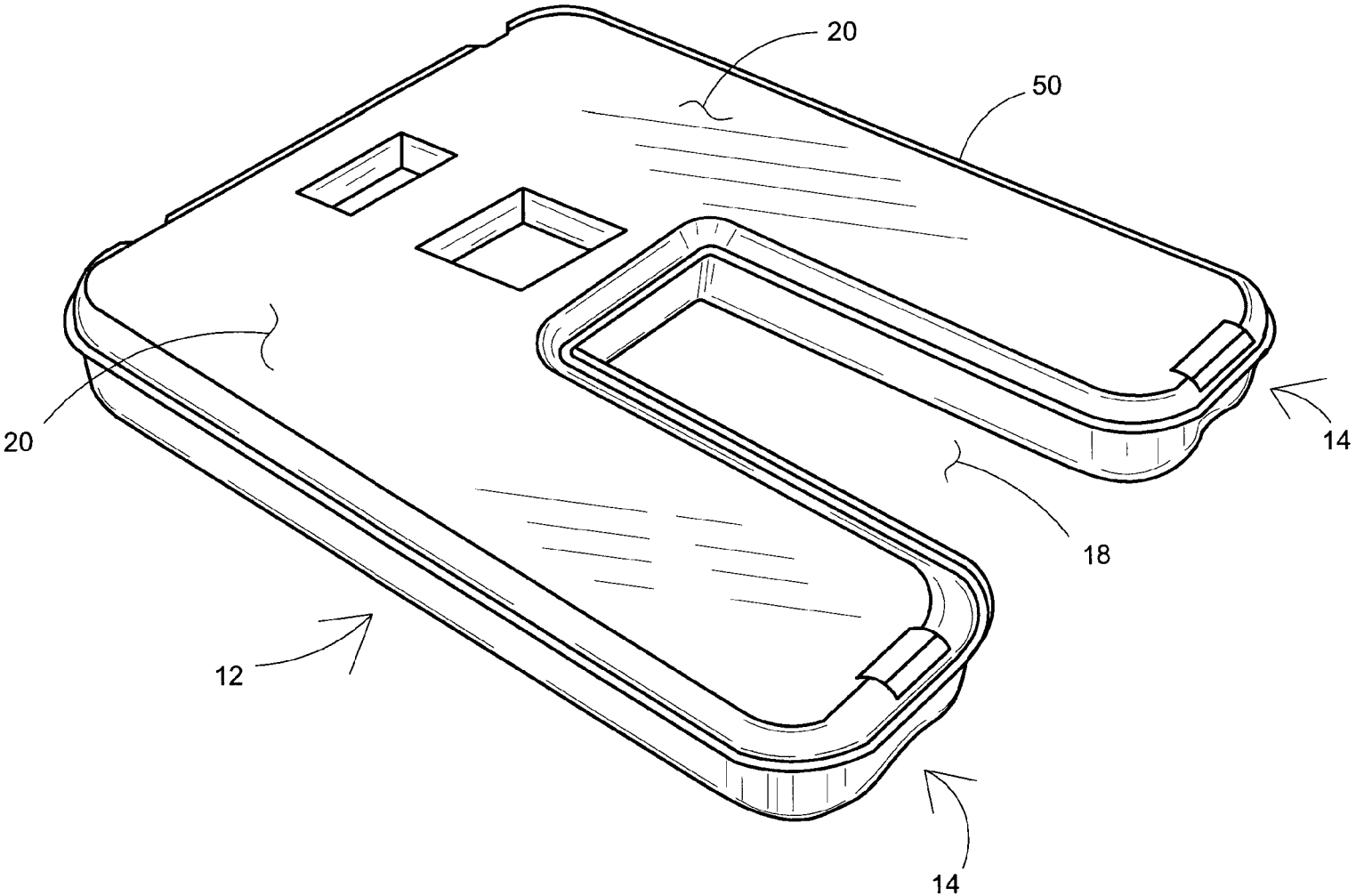
FIG. 6 is a top perspective view of the floating cabana base portion with base cover closed thereon.
Figure 7:
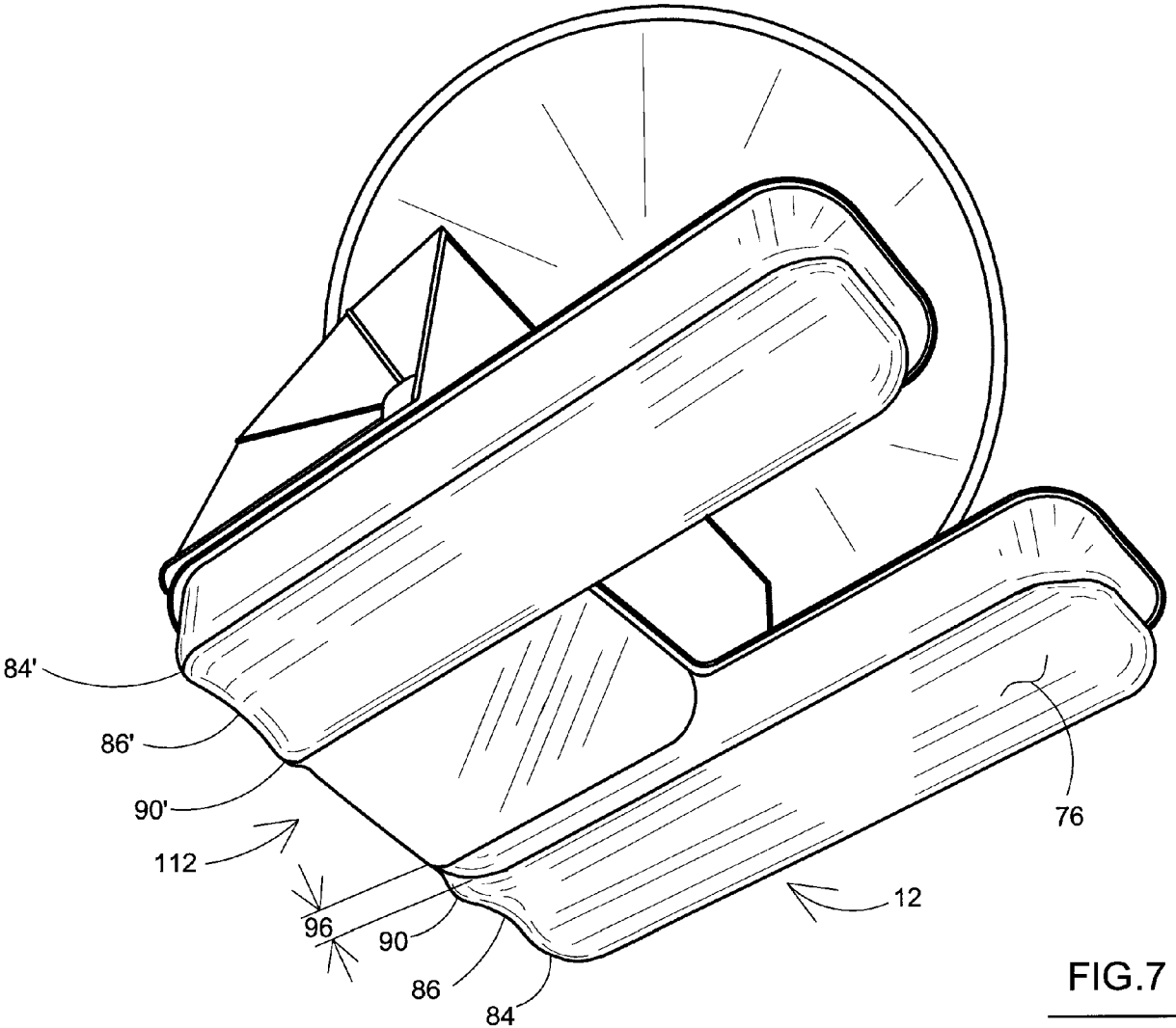
FIG. 7 is a bottom perspective view of the floating cabana.

The floating cabana or lounge 10 of the present invention is a floating lounge/cabana combination. Cabana 10 provides for a single base assembly 12. Base 12 may be made of any acceptable material such that the frame supports the desired weight and floats. Acceptable material must be such that it can support the weight at least 2 adults. Preferably, the base should be able to support 600 to 700 pounds.

Two lounge portions 14 and 16 extend outward from a platform area 20 such that the overall configuration is of a simplified squared letter "U." The area between each of lounge portions 14 and 16 are constructed and arranged such that passage 18 is formed therebetween. Passage 18 allows a user to move within the area of passage 18 or at least come within the cabana area in the center passage.

Base 12 is preferably formed of a vacuum molded shell. Base 12 may be formed of a single piece or a plurality of pieces.

Sizes, weights, and dimensions provided herein represent a preferred configuration for illustrative purposes only and are not intended to limit the configuration. Additionally, the figures presented herein are for illustrative purposed and not necessarily drawn to scale. In one embodiment, base 12 is formed of 3/16th inch UV resistant plastic. UV refers to ultraviolet light. Base 12 is approximately twelve inches high and weighs between 80-100 lbs. Foam pads 15 and 17 are secured to base 12 by adhesive.

As shown in FIGS. 2-6, base 12 is constructed and arranged with an interior cavity 40. Base structural support assembly 42 is positioned in interior cavity 40. Base lid 50 is affixed to base 12 in any acceptable manner to create an air tight seal of base lid 50 on base 12.

As seen in FIGS. 1, 7, 8, and 9, base 12 has platform area 20 on one end and each of first lounge portion 14 and second lounge portion 16 extend in the same direction from platform area 20.

A particular difficulty arises in successfully configuring the cabana 10 of the present invention. Typical water vessels having elongated side flotation portions and a portion between the side flotation portions, such as a sailboat or catamaran, have the central portion substantially centered between the ends of the flotation portions. The present invention is configured with platform area 20 at one end of the vessel. This configuration in a substantial block u-shaped configuration represents engineering challenges. The article must be configured such that a person in the water can enter of depart either lounge portion 14 or 16 in either central cavity 18 or from the outer sides of either lounge portion 14 and 16 while cabana 10 maintains relative horizontal stability and does not tip over in the water.

In order to achieve the desired stability, each lounge portion is similarly configured with a concave curvature extending from the front end of each lounge portion 14 and 16 along the length thereof and extending though platform area 20 such that the curvature extends substantially along the entire length of each side of cabana 10.

Figure 8:
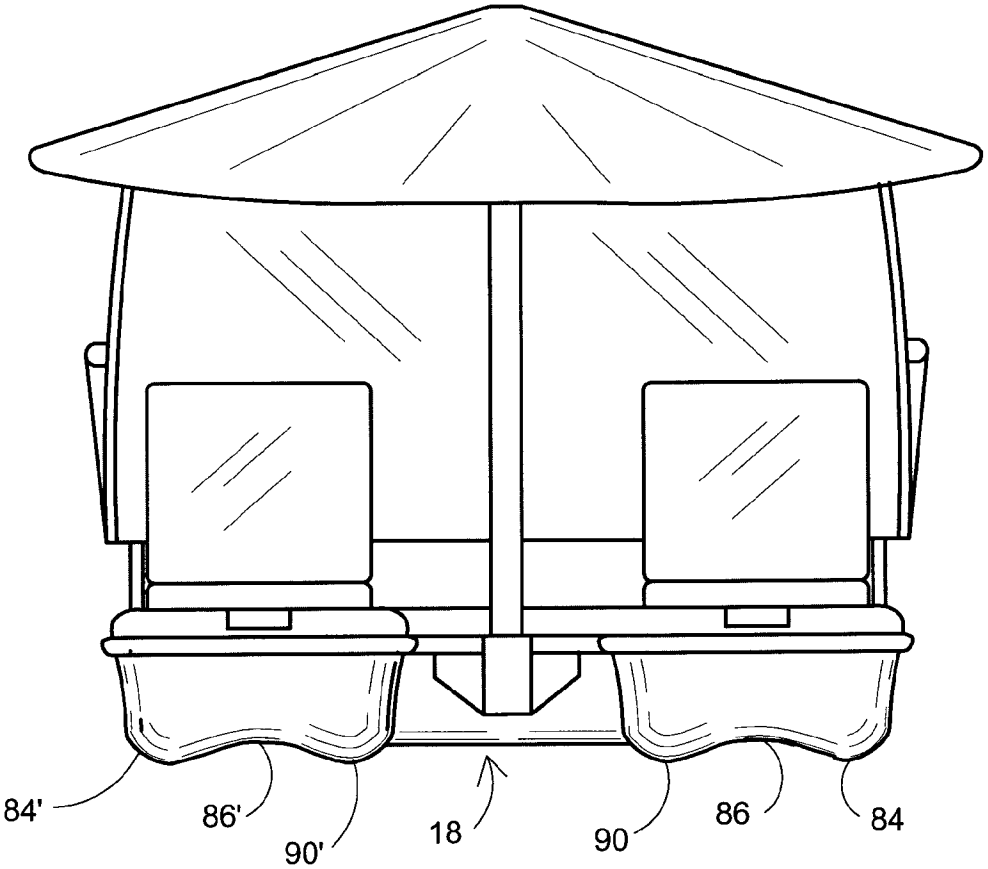
FIG. 8 is a front view of the floating cabana.
Figure 9:
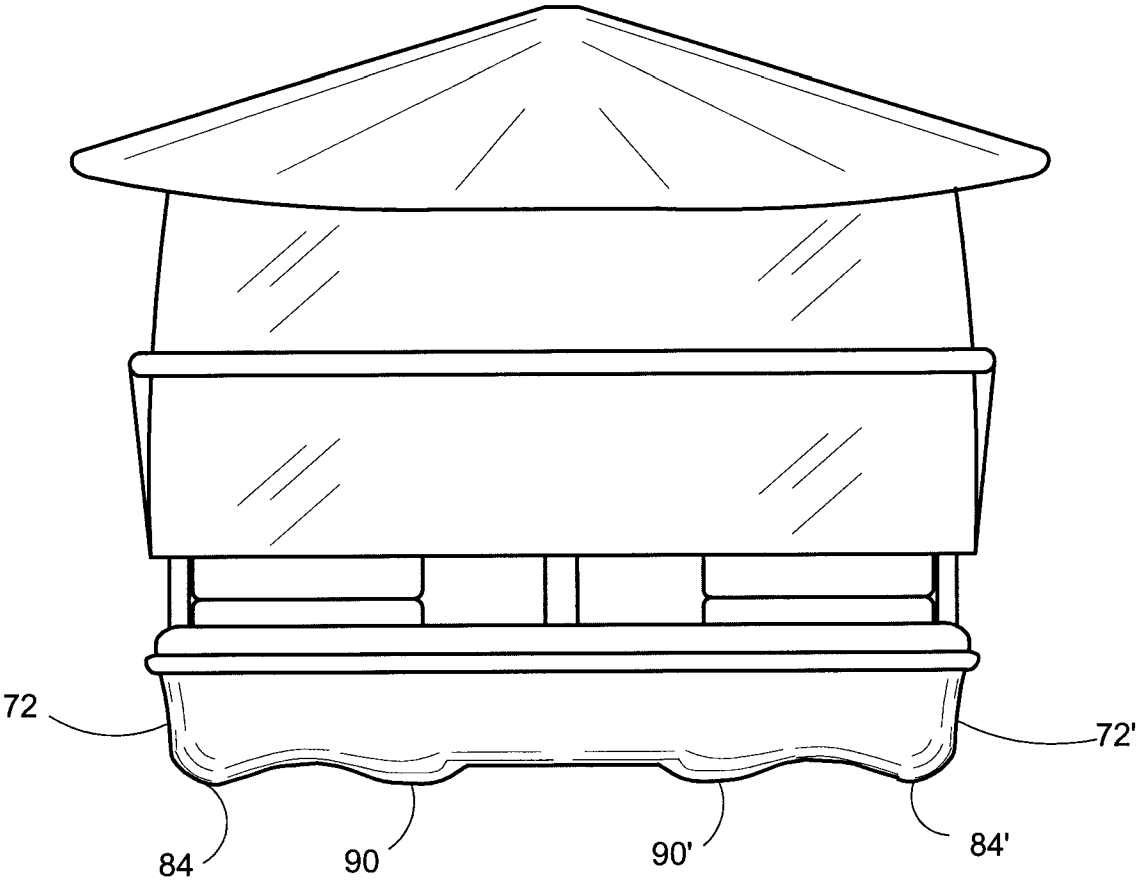
FIG. 9 is a rear view of the floating cabana.

As seen in FIG. 8, front face 60 of lounge portion 16 is configured with a base having a length 62, extending inward from inner wall 70 and outer wall 72. A curved portion 66 defines a curved cavity 76 (shown in FIG. 7) which extends the length of each side of cabana 10. Curved portion 66 has a maximum height 64 defined when cabana 10 is placed on a flat surface. The distance of lengths 62, height 64, and degree of curvature of curved portion 66 have been arrived at through careful experimentation and engineering such that a person entering cabana 10 from either passage 18 or from the outside of either lounge 14 or 16 does not tip over cabana 10 in the water.

The engineering of curved cavity 76 imparts the desired stability such that any displacement of cabana 10 from a substantially horizontal plane, when cabana 10 is in the water, does not tip over or capsize cabana 10.

Figure 10:
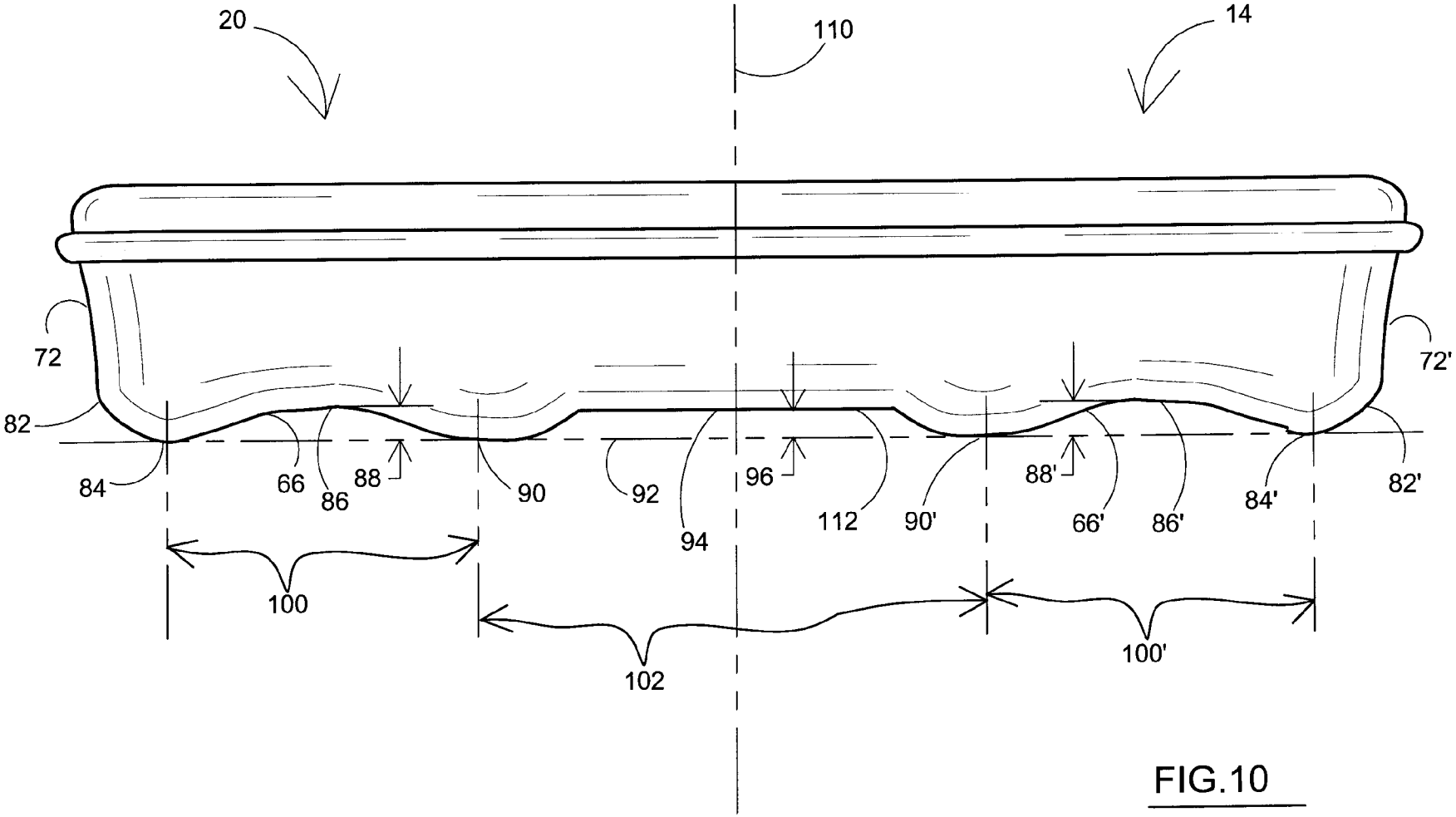
FIG. 10 is a cross section along line A-A from FIG. 1 showing the curvature of the base on the underside of the lounge portions.

As seen in FIG. 10, the curvature can be described as having a constant radius curve defined by each of curved portions 66 and 66' under each of lounge portions 16 and 14 respectively. In one embodiment, the constant radius curve is a 13.5 inch constant radius curve. For illustrative purposes, axis 92 represents the horizontal plane in which the lowest points of base 12 lie. Base 12 has an outer curved inflection point 82 and 82' that curve inward towards central axis line 110. Outer radius curve points 84 and 84' lie in plane 92 and represent the point at which the constant radius curve defined by each of curved portions 66 and 66' begin. Peak points 86 and 86' represent the peak of the constant radius curve. In one embodiment, peak points 86 and 86' have a peak height or amplitude 88 and 88' being a vertical distance above plane 92. In one embodiment, base 12 has an overall height above plane 92 of approximately ten inches and amplitude 88 and 88' is approximately 2.25 inches. Inner radius curve points 90 and 90' define the length of the radius curve as being curvature along curve portion 66 and 66' from outer radius curve points 84 and 84'. Each of inner radius curve points 90 and 90' lie in plane 92. The horizontal length in relation to base 12 of each radius curve is defined by distance 100 and 100' being the horizontal distance along plane 92 from 84 to 90 and 84' to 90' respectively.

Each of inner radius curve points 90 and 90' represent a point of inflection wherein the curvature of base 12 continues inward until a horizontal bottom 112 of platform area 20 is reached. Horizontal bottom 112 has a height 96 from plane 92 to bottom of platform 20 at bottom point 94 of approximately 2 inches.

The present invention provides a floating cabana 10 with stability in the water such cabana tilts from sided to side when a person goes on or off either of lounge portions 14 or 16 such that the side to side tilting does not turn over or capsize the cabana.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A floating lounge comprising, a unitary U-shaped hull, including an elongated right pontoon and an elongated left pontoon, said elongated right pontoon and said elongated left pontoon having a first end, a transom integral with said elongated right pontoon and said elongated left pontoon, said transom located about said first end, said transom having a top side and a water contacting side, and said elongated right pontoon having a top side and a water contacting side, and said elongated left pontoon having a top side and a water contacting side, said unitary U-shaped hull having an interior cavity, said interior cavity including a lattice of vertical support elements therein, said water contacting side of both said elongated right pontoon and said elongated left pontoon being concave, and further said water contacting side of said transom being horizontal, wherein said elongated right pontoon includes a first lounge cushion on said elongated right pontoon top side, and said elongated left pontoon includes a second lounge cushion on said elongated left pontoon top side, said first lounge cushion and said second lounge cushion are parallel to one another.

2. A floating lounge as claimed in claim 1 wherein said first lounge cushion has an inner side and an outer side, said first lounge cushion said inner side proximal to said aperture, and a second lounge cushion has an inner and an outer side, said second lounge cushion said inner side also proximal to said aperture, said first lounge outer side and second lounge outer side are adapted to receive a vertical element thereon, said vertical elements are connected by a flexible material about a rear side of said transom, forming a flexible wall covering a portion of said first lounge cushion located about said transom and a portion of said second lounge cushion located about said transom and said rear side of said transom.

3. A floating lounge as claimed in claim 2 when said flexible wall is extended, and said umbrella is opened, an enclosure is formed whereby a user or users may reside on said first lounge cushion and said second lounge cushion in a protected fashion.

4. A floating lounge as claimed in claim 3 wherein said unitary U-shaped hull is formed of UV resistant plastic.

5. A floating lounge comprising, a unitary U-shaped hull, including an elongated right pontoon and an elongated left pontoon, said elongated right pontoon and said elongated left pontoon having a first end, a transom integral with said elongated right pontoon and said elongated left pontoon, said transom located about said first end, said transom having a top side and a water contacting side, and said elongated right pontoon having a top side and a water contacting side, and said elongated left pontoon having a top side and a water contacting side, said unitary U-shaped hull having an interior cavity, said interior cavity including a lattice of vertical support elements therein, said water contacting side of both said elongated right pontoon and said elongated left pontoon being concave, and further said water contacting side of said transom being horizontal, said elongated right pontoon includes a first lounge cushion on said elongated right pontoon top side, and said elongated left pontoon includes a second lounge cushion on said elongated left pontoon top side, said first lounge cushion and said second lounge cushion are parallel to one another, said first lounge cushion and said second lounge cushion are attached respectively to said elongated right pontoon top side and said elongated left pontoon top side by an adhesive.

6. A floating lounge including a hull comprising;

a first elongated hull portion having a forward end and a rear end, a second elongated hull portion having a forward end and a rear end, said first elongated hull portion and said second elongated hull portion having a first length, said first elongated hull portion and said second elongated hull portion being spaced apart and parallel, a third hull portion having a forward end and a rear end, said third hull portion having a second length less than said first length, said third hull portion extending transversely between said first elongated hull portion rear end and said second elongated hull portion rear end, permitting water to flow between said first elongated hull portion and said second elongated hull portion to said forward end of said third hull, said first elongated hull portion includes a first bottom, said second elongated hull portion includes a second bottom and said third hull portion includes a third bottom, where said first bottom, said third bottom and said second bottom form a bottom, said hull is covered by a top element forming an interior, and said interior including a lattice of vertical support elements intermediate said bottom and said top element, said first elongated hull portion includes a first cushion on said top element, and said second elongated hull portion includes a second cushion on said top element, said first cushion and said second cushion are parallel.

7. A floating lounge as claimed in claim 6 wherein said hull is formed of UV resistant material.

8. A floating lounge as claimed in claim 7 wherein an umbrella holder is disposed on a center portion of said third hull portion forward end, said umbrella holder adapted to receive an umbrella therein.

9. A floating lounge as claimed in claim 8 wherein a U-shaped cabana is provided proximal said rear end of said first elongated hull portion, said rear end of said second elongated hull portion and said rear end of said third hull portion.

10. A floating lounge comprising, a unitary U-shaped hull, including an elongated right pontoon and an elongated left pontoon, said elongated right pontoon and said elongated left pontoon having a first end, a transom integral with said elongated right pontoon and said elongated left pontoon, said transom located about said first end, said transom having a top side and a water contacting side, and said elongated right pontoon having a top side and a water contacting side, and said elongated left pontoon having a top side and a water contacting side, said elongated right pontoon includes a first lounge cushion on said elongated right pontoon top side, and said elongated left pontoon includes a second lounge cushion on said elongated left pontoon top side, said first lounge cushion and said second lounge cushion are parallel to one another.

11. A floating lounge as claimed in claim 10 wherein said unitary U-shaped hull includes an interior cavity, said interior cavity further including a lattice of vertical support elements therein, and said water contacting side of both said elongated right pontoon and said elongated left pontoon being concave, and further said water contacting side of said transom being horizontal.

12. A floating lounge as claimed in claim 10 wherein said transom has a front side, said transom front side including an aperture, a pole where a first side of said pole is located in said aperture, and a second side of said pole includes an umbrella thereon, said transom front side further including a first and second beverage holder, said first beverage holder located to the right of said aperture, and said second beverage holder located to the left of said aperture, said unitary U-shaped hull having an interior cavity, said interior cavity including a plurality of vertical support elements therein, said water contacting side of both said elongated right pontoon and said elongated left pontoon being concave, and further said water contacting side of said transom being horizontal.

* * * * *